US005101565A

United States Patent [19]

Trankiem

[11] Patent Number: 5,101,565

[45] Date of Patent: Apr. 7, 1992

[54] RAZOR BLADES

[75] Inventor: Hoang M. Trankiem, Watertown, Mass.

[73] Assignee: The Gillette Company, Boston, Mass.

[21] Appl. No.: 741,843

[22] Filed: Aug. 7, 1991

Related U.S. Application Data

[63] Continuation-in-part of Ser. No. 663,230, Mar. 1, 1991, abandoned.

[51] Int. Cl.[5] ..... B26B 21/54

[52] U.S. Cl. ..... 30/346.54; 76/104.1; 76/DIG. 8

[56] References Cited

U.S. PATENT DOCUMENTS 3,829,969 8/1974 Fisckbein et al. ..... 30/346.54

3,911,579 10/1957 Lane et al. ..... 30/346.54

4,330,576 5/1982 Dodd ..... 76/Dig 8

[58] Field of Search ..... 30/346.54, 350, 345; 76/101.1, 104.1, DIG. 8

*Primary Examiner*—Douglas D. Watts

[57] ABSTRACT

Improved razor blades and methods for producing the blades. The cutting edge regions of the blades include a solid adherent coating which is the residue of a heated mixture of a fluorocarbon polymer and a silane. The mixture is applied to the cutting edge regions of the blade and heated to a temperature sufficient to melt the fluorocarbon. The coatings achieved in the practice of the invention provide blades having improved shaving performance characteristics for the blade.

24 Claims, No Drawings

RAZOR BLADES

CROSS REFERENCE TO RELATED APPLICATIONS

This application is a continuation-in-part of application Ser. No. 663,230 filed Mar. 1, 1991.

BACKGROUND OF THE INVENTION

Part 1. The Field of the Invention

This invention relates to razor blades having improved shaving performance characteristics and to methods for making the improved razor blades.

Part 2. Description of the Prior Art

It is known that the shaving performance characteristics of razor blades can be improved by applying thin, adherent coatings of materials such as organosiloxane gels and fluorocarbon polymers to the cutting edge regions of razor blades. Razor blades including such coatings are described in detail in U.S. Pat. Nos. 2,937,967; 3,071,856 and 3,518,110. All of the above Patents are expressly incorporated herein in their entirety by reference.

SUMMARY OF THE INVENTION

In accordance with the practice of the present invention, razor blades having improved shaving performance characteristics are produced by applying a dispersion comprising a mixture of a fluorocarbon polymer and a silane to the cutting edge regions of blades The dispersion is then heated to provide a coalesced, solid, adherent coating product of the heated fluorocarbon/silane mixture on the cutting edge regions and especially on or near the ultimate edge of the blade I presently believe that there is an interaction between the polymer and the silane during formation of the coating. I further believe that the interaction produces a superior coating and/or superior bonding of the coating to the cutting edge regions which provide improved shaving performance characteristics including improved comfort, smoothness and closeness coupled with increased shaving life.

DESCRIPTION OF PREFERRED EMBODIMENTS

Preferred razor blades of the invention have adjacent cutting edge regions extending backwardly from the ultimate edge. The cutting edge regions of the preferred blades may be formed of razor blade carbon or stainless steels and the regions may or may not be coated with metals or metal alloys or other materials. Representative preferred blades have thicknesses between about 30 to about 375 microns with wedge-shaped cutting edge regions extending backwardly from the ultimate edge for a distance of about 0.025 cm or even more. The cutting edge regions may be defined by single facets on opposed sides or by two or more facets formed on opposed sides by successive grinding or honing operations. The facets on the cutting edge regions immediately adjacent the ultimate edge may have a width as low as about 20 microns, while the thickness of the ultimate edge itself is generally about 0.03 microns and usually no more than about 0.16 microns. Other features, properties, characteristics and treatments relating to the preferred razor blades are described in the incorporated Patents. Preferred razor blades of the present invention include cutting edge r regions coated with metals or other materials to improve the strength, hardness, durability, corrosion resistance or other such properties of the cutting edge regions The especially preferred razor blades include cutting regions coated with thin coatings of chromium or chromium and platinum (Cr/Pt). The especially preferred blades are described in U.S. Pat. Nos. 3,829,969 and 3,632,795 which are also incorporated herein by reference.

Fluorocarbon polymeric materials useful in the practice of the invention are solid polymers of tetrafluoroethylene including chains containing a plurality of $-CF_2-CF_2-$groups. The molecular weight of the tetrafluoroethylene polymers may vary from about 2,000 or lower to about 2,000,000 or higher. Preferred fluorocarbon polymers are those described in incorporated U.S. Pat. No. 3,518,110. Essentially, they contain a chain of carbon atoms including a preponderance of $-CF_2-CF_2-$groups and melting points between about 320° C. and about 332° C. and a melt flow rate from about 0.005 to about 600 grams per ten minutes (as defined in U.S. Pat. No. 3,518,110). A particularly preferred fluorocarbon polymer is a fluorotelomer having a molecular weight of about 25,000 and a melting point of 325° C. and is sold commercially under the tradename VYDAX 1000 by E.I. Dupont de Nemours Inc.

Broadly, silanes presently believed to be suitable in the practice of the invention are silanes which conform to the following structural formula;

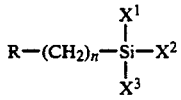

where R is hydrogen or R is an organic radical such as an alkyl radical, an alkene radical, a vinyl radical, an amino radical or an epoxy radical, or a mercapto radical, n is 0, 1, 2 or 3 and $X^1$, $X^2$ and $X^3$ represent hydrolyzable groups such as halogen, hydroxyl or alkoxy groups. Particularly preferred silanes are vinyl trialkoxysilanes such as vinyl trimethoxysilane and vinyl triethoxysilane. Vinyl trimethoxysilane represents the particularly preferred silane for use with the fluorocarbon polymer.

In the preferred practice of the invention, the fluorocarbon polymer/silane mixture is applied to the cutting edge regions of the blade in the form of a dispersion. Preferably, the polymer and silane are dispersed in the form of finely divided particles in an inert volatile liquid such as water, alcohols or ethers. The polymer/silane dispersion may be applied to the cutting edge regions in any manner which can provide a substantially uniform coating of the dispersion on the edge regions. Suitable application methods include dipping, spraying and nebulization among others. Preheating of the blades may be employed if desired and is preferably employed to facilitate spraying and to enhance condensation of silane onto blade edge. The cutting edge regions of the blades may be preheated to temperatures approaching the boiling point of the liquid of the dispersion.

Alternatively, the silane may be dissolved in a mixture of water and alcohol and the solution is then applied to the blade first. The blade may also be heated prior to the application of the silane solution. A dispersion of the fluorocarbon in an alcohol, for example isopropanol, is then applied to the cutting edge regions. After application of the fluorocarbon dispersion to the cutting edge regions, the blade is heated at an elevated temperature (above the melting point of the fluorocarbon polymer) to form an adherent coating of the polymer/silane mixture. The time of heating will vary depending upon such factors as the particular polymer and silane mixture involved, the nature of the cutting edge region, the temperature achieved and the nature of the atmosphere in which the blade is heated. While the blades may be heated in air, the preferred method involves heating the blades in an atmosphere of inert gas such as argon, helium, nitrogen, etc. The heating must be sufficient to permit the individual polymer and silane particles to coalesce, fuse and spread into a substantially continuous film and to cause the coalesced residue to be firmly adhered to the material of the cutting edge region.

As noted in the incorporated Patents, the heating conditions such as maximum temperature, time of heating, atmosphere, etc., must be adjusted and controlled to avoid substantial decomposition or degradation of the polymer and/or silane or the coating obtained by heating the polymer/ silane mixture. Additionally, the heating conditions must be selected and controlled to avoid excessive tempering and/or softening of the cutting edge region metal. Preferably, the heating temperature should not exceed about 400° Celsius The invention as well as details and features thereof will be better appreciated by reference to the following illustrative, non-limiting Examples:

EXAMPLE 1

A dispersion containing 0.7% by weight solid fluorocarbon polymer (VYDAX 1000) and 0.7% by weight of vinyl trimethoxysilane in isopropanol was prepared and homogenized with an ultrasonic stirrer. The dispersion of polymer and silane was sprayed on razor blades having cutting edge regions which had been sputter coated with a 325A coating of Cr/Pt. The blades were heated to a temperature of 100° C. before spraying to enhance condensation of silanol groups at the metal surfaces and to remove traces of methanol from the hydrolysis of the methoxysilane. After spraying, the blades were heated in a sand bath under nitrogen at 650° F. for 35 minutes.

An shave test was conducted to compare the shaving performance characteristics of blades of Example 1 with control razor blades which had been sputter coated with a 325A coating of Cr/Pt and had a solid adherent coating of VYDAX 1000 alone on the cutting edge portions. Razor blades of the Example scored significantly higher in overall shaving characteristics over the control blades, especially in terms of comfort, smoothness and closeness. Additionally, razor blades of the Example had significantly increased shaving life.

EXAMPLE 2

Razor blades were preheated at 75° C. for 15 minutes. A solution containing 5% of N-(β-aminoethyl)-γ-aminopropyl trimethoxysilane in isopropanol was sprayed on the preheated blades the cutting edges of which had been coated with a 325 A layer of Cr/Pt. After spraying, the blades were heated at 75° C. for an additional 15 minutes to enhance the condensation of silanol groups at the metal surfaces and to remove traces of methanol from the hydrolysis of the methoxysilane. A dispersion containing 0.7% by weight solid fluorocarbon polymer (Vydax 1000) in isopropanol was prepared and homogenized with an ultrasonic stirrer. The dispersion of polymer was sprayed on the silane coated blade and the blades were heated in a sand bath under nitrogen at 650° F. for 35 minutes.

EXAMPLE 3

Example 2 was repeated but the blades were preheated at 100° C. for 20 minutes before spraying with a dispersion consisting of 1% 3-glycidoxypropyltrimethoxysilane in 10% of a 0.1% aqueous acetic acid solution and 89% isopropanol.

After spraying, the blades were heated at 100° C. for 20 minutes to enhance the condensation of silanol groups at the metal surfaces and to remove traces of methanol from the hydrolysis of the methoxysilane. A dispersion containing 0.7% by weight solid fluorocarbon polymer (Vydax 1000) was prepared and homogenized with an ultrasonic stirrer. The dispersion of polymer was sprayed on the silane coated blade and the blades were heated in a sand bath under nitrogen at 650° F. for 35 minutes.

EXAMPLE 4

Example 2 was repeated but with a dispersion of 1.5% γ-mercaptopropyltrimethoxysilane in 7.5% water and 91% isopropanol that was prepared 17 hours before use. Blades were preheated at 100° C. for 20 minutes and maintained at 100° C. for 20 minutes after spraying to enhance the condensation of silanol groups at the metal surfaces and to remove traces of methanol from the hydrolysis of the methoxysilane. A dispersion containing 0.7% by weight solid fluorocarbon polymer (Vydax 1000) was prepared and homogenized with an ultrasonic stirrer. The dispersion of polymer was sprayed on the silane coated blade and the blades were heated in a sand bath under nitrogen at 650° F. for 35 minutes.

What is claimed is:

1. A razor blade having cutting edge regions carrying a solid adherent coating formed by heating a fluorocarbon polymer and silane mixture to melt the polymer.

2. A razor blade of claim 1 where the fluorocarbon polymer has a melting point between about 310° C. and about 332° C. and a melt flow rate from about 0.005 to about 600 grams per ten minutes at 350° C.

3. A razor blade of claim 2 where the polymer is a fluorotelomer having a molecular weight of about 25,000.

4. A razor blade of claim 1 where the silane is a vinyl trialkoxysilane.

5. A razor blade of claim 4 where the silane is vinyl trimethoxysilane.

6. A razor blade of claim 1 where the cutting edge regions carry a Cr/Pt coating and the fluorocarbon polymer/silane coating is adhered to the Cr/Pt coating.

7. A razor blade of claim 1 where the silane is an aminosilane.

8. A razor blade of claim 7 where the silane is an N-(β-aminoethyl)-γ-aminopropyltrimethoxysilane.

9. A razor blade of claim 1 where the silane is an epoxysilane.

10. A razor blade of claim 9 where the silane is a 3-glycidoxypropyltrimethoxysilane.

11. A razor blade of claim 1 where the silane is a mercaptosilane.

12. A razor blade of claim 11 where the silane is a γ-mercaptopropyltrimethoxysilane.

13. A method for making a razor blade which comprises the steps of depositing a mixture of fluorocarbon polymer and silane on cutting edge regions of the blade and heating the mixture to a temperature sufficient to melt the polymer to form an adherent coating on the cutting edge regions.

14. A method of claim 13 where the fluorocarbon polymer has a melting point between about 310° C. to about 332° C. and a melt flow rate from about 0.005 to about 600 grams per ten minutes at 350° C.

15. A method of claim 14 where the polymer is a fluorotelomer having a molecular weight of about 25,000.

16. A method of claim 13 where the silane is a vinyl trialkoxysilane.

17. A method of claim 16 where the silane is a vinyl trimethoxysilane.

18. A method of claim 13 where the silane is an aminosilane.

19. A method of claim 18 where the silane is a N-(β-aminoethyl)-γ-aminopropyltrimethoxysilane.

20. A method of claim 13 where the silane is an epoxysilane.

21. A method of claim 20 where the silane is a 3-glycidoxypropyltrimethoxysilane.

22. A method of claim 13 where the silane is a mercaptosilane.

23. A method of claim 22 where the silane is a γ-mercaptopropyltrimethoxysilane.

24. A method of claim 13 where the cutting edge regions carry a Cr/Pt coating.

* * * * *